US009179817B2

(12) United States Patent
Fritz et al.

(10) Patent No.: US 9,179,817 B2
(45) Date of Patent: Nov. 10, 2015

(54) HOUSEHOLD APPLIANCE, IN PARTICULAR DISHWASHER, WITH AN ACOUSTIC SEALING FRAME FOR NOISE REDUCTION

(71) Applicant: BSH Bosch und Siemens Hausgeräte GmbH, Munich (DE)

(72) Inventors: Heiko Fritz, Herbrechtingen (DE); Andreas Hitzler, Holzheim (DE); Bernd Schwenk, Lauingen (DE)

(73) Assignee: BSH Hausgeraete GmbH, Munich (DE)

( * ) Notice: Subject to any disclaimer, the term of this patent is extended or adjusted under 35 U.S.C. 154(b) by 138 days.

(21) Appl. No.: 13/747,506

(22) Filed: Jan. 23, 2013

(65) Prior Publication Data

US 2013/0193826 A1 Aug. 1, 2013

(30) Foreign Application Priority Data

Jan. 30, 2012 (DE) ..... 10 2012 201 276

(51) Int. Cl.
*A47L 15/42* (2006.01)
*D06F 39/12* (2006.01)

(52) U.S. Cl.
CPC ..... *A47L 15/4255* (2013.01); *D06F 39/12* (2013.01); *A47L 15/4246* (2013.01)

(58) Field of Classification Search
CPC .. A47L 15/4251; A47L 15/4255; D06F 39/12
USPC ..... 312/400, 401, 406, 228; 181/200, 284, 181/290, 294; 134/25.2, 56 D
See application file for complete search history.

(56) References Cited

U.S. PATENT DOCUMENTS

| | | | | | |
|---|---|---|---|---|---|
| 2,863,179 | A | * | 12/1958 | Gaugler | 52/406.2 |
| 2,981,361 | A | * | 4/1961 | Schofield | 181/290 |
| 5,044,705 | A | * | 9/1991 | Nelson | 312/228 |
| 5,416,285 | A | * | 5/1995 | Niehaus | 181/287 |
| 5,965,851 | A | * | 10/1999 | Herreman et al. | 181/200 |
| 6,109,712 | A | * | 8/2000 | Haworth et al. | 312/400 |
| D460,201 | S | * | 7/2002 | Lisula | D25/126 |
| 2002/0134615 | A1 | * | 9/2002 | Herreman et al. | 181/290 |
| 2006/0266385 | A1 | * | 11/2006 | Malaker | 134/56 D |
| 2007/0119481 | A1 | * | 5/2007 | Jerg | 134/25.2 |
| 2008/0160857 | A1 | * | 7/2008 | Chacko et al. | 442/342 |
| 2013/0106264 | A1 | | 5/2013 | Fritz et al. | |

FOREIGN PATENT DOCUMENTS

| | | | |
|---|---|---|---|
| AT | 306292 | B | 4/1973 |
| DE | 4443918 | A1 | 6/1996 |
| DE | 4443919 | A1 | 6/1996 |
| DE | 102010002126 | A1 | 8/2011 |
| DE | 102010031485 | A1 | 1/2012 |
| WO | WO 2011/016693 | * | 2/2011 |

OTHER PUBLICATIONS

European Search Report dated Jun. 13, 2013.
Report of Examination DE 10 2012 201 276.1 dated Oct. 10, 2012.

* cited by examiner

*Primary Examiner* — James O Hansen
(74) *Attorney, Agent, or Firm* — James E. Howard; Andre Pallapies

(57) ABSTRACT

A household appliance includes appliance walls which delimit a space. A covering plate is arranged on an outer face of at least one of the appliance walls so as to leave free a gap. The gap is sealed in an edge region of the covering plate by an acoustic sealing frame.

59 Claims, 4 Drawing Sheets

HOUSEHOLD APPLIANCE, IN PARTICULAR DISHWASHER, WITH AN ACOUSTIC SEALING FRAME FOR NOISE REDUCTION

BACKGROUND OF THE INVENTION

The invention relates to a household appliance with a space, present in particular in its interior, surrounded by appliance walls, in particular a dishwasher with a dishwasher interior. The appliance walls often have, by way of example for processing, shaping and/or cost reasons, only a low thickness, so noises which are produced in the space easily penetrate to the outside, and this is undesirable. Apart from an anti-drumming mat optionally attached to the outside of the outer face of the respective appliance wall, such as a bitumen mat for preventing or at least damping vibrations of the appliance wall which lead to thudding noises, for noise insulation there is often an all-over acoustic insulating layer preferably on the outside of the respective appliance wall overlaid with a bitumen mat, and this layer is made from a noise-absorbing and/or noise-reflecting material, made by way of example from an absorbent fleece. To ensure sufficient noise insulation of the space surrounded by device walls, a relatively thick insulating layer of, by way of example, 2 cm or more is often required, and this necessitates a correspondingly large installation space which is then no longer available for other purposes, by way of example to increase the washing tank of a dishwasher.

Taking this as a starting point, it is an object of the invention to propose a household appliance, in particular a dishwasher, of the type mentioned in the introduction with noise insulation which is improved with respect to its space requirement.

BRIEF SUMMARY OF THE INVENTION

According to one aspect of the present invention, a household appliance includes appliance walls which delimit a space, a covering plate, i.e. a covering element, which is arranged on an outer face of at least one of the appliance walls so as to leave free a gap, and an acoustic sealing frame sealing the gap in an edge region of the covering plate.

According to another aspect of the present invention, a household appliance, in particular a dishwasher, includes an appliance wall which delimits a space, an acoustic sealing frame which is provided along an edge zone section of the appliance wall to enclose the appliance wall and which projects outwardly with respect to an outer face of the appliance wall by a predefined transverse distance, and a covering plate which is attached to an outside of the acoustic sealing frame in such a way that an outer face of the appliance wall is covered by the covering plate to provide noise insulation.

The acoustic sealing frame is in particular made at least partially from an airborne-noise absorbing and/or reflecting sealing material. As a result, the gap in the edge region of the covering plate may be perfectly acoustically insulated and a closed insulating cover consisting of the combination of sealing frame and covering plate provided for the respective appliance wall, so the passage of sound through the appliance wall can be sufficiently reduced.

Soundwaves from the inside of the space surrounded by appliance walls can be absorbed, i.e. swallowed, in particular if the sealing frame is made from a noise-absorbing material, in particular elastically and/or plastically deformable material, preferably foam, absorbent fleece or felt.

According to an advantageous development of the invention the acoustic sealing frame is formed in particular by a structured or panel element, in particular an acoustic and optionally additionally thermal insulation mat which has a through-opening. This through-opening is closed by the covering plate. In other words, the sealing frame preferably has a, in particular substantially rectangular, geometric shape which encloses the through-opening all the way around, and is in particular mounted on an associated edge zone of the respective appliance wall. The acoustic sealing frame is expediently attached to the respective appliance wall in such a way that its through-opening comes to rest over a potentially present three-dimensionally contoured, in particular uneven or outwardly projecting, partial area of the appliance wall. Whereas the sealing frame preferably rests largely completely on a substantially plane partial area, in particular edge zone area, of the respective appliance wall, the covering plate is arranged over the through-opening with the three-dimensional shaping, in particular uneven or outwardly projecting partial area of the appliance wall, and preferably covers it from the outside so as to sit on an edge zone of the sealing frame and overlap its through-opening.

The covering plate can in particular thus have a relatively small thickness, in particular a smaller layer thickness than the material of the acoustic sealing frame. It can therefore be installed over the appliance wall on or in the sealing frame so as to close the through-opening thereof, where externally—in particular owing to an outward curve in the appliance wall—there is a smaller installation space extent than in the remaining regions of the appliance wall, in order to be able to adhere to predefined appliance dimensions. In the case of a dishwasher this is by way of example the central region of the top wall of the washing tank, since the top wall is outwardly convexly curved for improved dripping behavior of droplets of liquid which have been sprayed onto it in the dishwasher interior of the washing tank. The covering plate can advantageously be constructed so as to be substantially plane.

A specially manufactured shaped part, such as a pre-embossed absorbent fleece, i.e. three-dimensionally shaped embossed fleece, is therefore no longer required which is laid completely over the entire outer face of the respective appliance wall and whose bottom overlay contour is constructed so as to be substantially complementary to the external contour of the appliance wall—in the case of a dishwasher, the washing tank wall—, and this renders its production complex and cost-intensive. Since, by contrast, an acoustic insulating cover can now be provided largely independently of the physical shaping, in particular outward and/or inward elevations, of the respective appliance wall, viewed perpendicular to its location plane, by means of the combination of acoustic sealing frame and covering plate as a whole for the respective appliance wall, mass production of household appliances, in particular dishwashers, is simplified by the inventive noise-reduction system comprising sealing frame and covering plate. Storage in particular is simplified because it is now no longer necessary to keep in stock specific three-dimensionally contoured sound insulation shaped parts respectively for different height profiles of appliance walls. Furthermore, compared to a single pre-embossed shaped part which externally completely covers the respective appliance wall, an at least substantially equally efficient or even improved soundproofing effect may be ensured by the inventive noise-reduction system comprising sealing frame and covering plate.

In the case of the inventive noise-reduction system it is advantageously sufficient if the covering plate is in particular made from a material which primarily brings about air-borne noise damping, i.e. a reflection of the air-borne noise prevailing in the gap. A substantially air-borne noise-damping material of this kind can be produced in particular from fibers, preferably cotton, kenaf, and/or synthetic fibers, such as polyester fibers, or from embossed fleece or felt, cardboard, and/or plastic, and/or metal. The material, which can consist by way of example of fibers such as cotton, kenaf and/or synthetic fibers, such as polyester fibers, embossed fleece or felt, cardboard, and/or of a plastic material not constructed from fibers, or metal, can, however, optionally also have noise-damping, i.e. noise-absorbing properties. If the covering plate is produced from an embossed fleece, in particular planar embossed fleece mat, then this variant uses less material, is easier to produce and less expensive than a contoured embossed fleece which overlays the entire outer face of the respective appliance wall.

For example disruptive air-borne noise produced in the respective space, in particular the treatment space, such as by way of example in the dishwasher interior of the washing tank of a dishwasher, is transmitted via an appliance wall into said gap, and/or air-borne noise produced by vibrations of the respective appliance wall is radiated into the free space between the respective appliance wall and the covering plate arranged at a transverse distance therefrom, preferably substantially parallel to it, but is at least partially reflected and/or absorbed by the covering plate there. Soundproof sealing of the gap in the edge region of the covering plate prevents the air-borne noise from being able to spread outwards unhindered. A primarily noise-absorbing material, for instance a foam or an absorbent fleece, such as a polyester and/or cotton fleece, may be considered as a sealing material for the sealing frame. The sealing material can of course also have a sound-absorbing effect, it being possible for its acoustic sealing function to optionally be based solely on this property. The gap width of the gap that exists between the covering plate and an appliance wall can also be kept relatively small, and be by way of example just a few millimeters. Overall the space requirement of the proposed sound insulation, viewed in a direction transverse to the location plane of the appliance wall, can therefore be reduced to just a few millimeters and the space allowance inside the housing of the household appliance can be increased thereby.

The sealing material which partially or completely forms the sealing frame, which is by way of example a sound-absorbing foam or an absorbent fleece, such as a cotton and/or polyester fleece, is preferably elastically and/or plastically deformable. Irregularities in an appliance wall, for instance troughs or projections therein, can advantageously be compensated thereby. An embodiment of the sealing frame which exactly complements the physical shape of the appliance wall, in order to ensure an acoustically tight seal of the gap, is not necessary. A material of this kind can form a sealing frame as a whole or, by way of example, together with a reinforcing material, by way of example a metal and/or a plastic. An especially compact arrangement is provided in particular if the sealing frame is arranged at least partially within the gap. The width of the gap can then be easily predefined preferably by the thickness of the sealing frame.

In a particularly preferred variant there is an anti-drumming layer, constructed in particular as a bitumen layer, on the at least one appliance wall. A heavy layer of this kind is used to dampen vibrations of the respective appliance wall which are caused by way of example by a mechanical coupling of the appliance wall with a vibrating component, for instance a motor, or, as is the case with a dishwasher, by water jets striking the inside of the washing tank.

A covering plate and a sealing frame associated with it cover an appliance wall as extensively as possible to ensure sufficient sound protection. In this sense it is optionally also advantageous to provide a corner region of the space of the inventively constructed household appliance, i.e. a region at which two adjacent appliance walls of the household appliance abut, with sound protection of the proposed kind, i.e. with a covering plate mounted in front of the respective appliance wall at a predefined gap spacing, and a sealing frame for covering or sealing the edge gap between the edge zone of the covering plate and the outer face of the appliance wall.

According to an advantageous development of the invention the sealing frame and the covering plate can be easily fixed to each other in terms of production engineering, and in particular mechanically secured to each other—for example by clips—and/or glued. Fixing, in particular mechanical securing and/or gluing, can also be provided for the direct or indirect fixing of the sealing frame to an appliance wall.

Additionally or independently hereof advantageous securing of sealing frame and covering plate can be brought about in that these are positively held in a gap space present between an appliance wall and an external housing wall of the household appliance which flanks this appliance wall. With appropriate dimensioning of covering plate and sealing frame these are fixedly held in the gap space, so gluing of the sealing frame to the appliance wall, or an anti-drumming mat present there, and opposing gluing of sealing frame and covering plate can optionally be omitted.

A separate covering plate is not provided in a further preferred embodiment. Instead it is formed by a housing wall, in particular an external housing wall, of the household appliance. The outer face of the covering plate, which by way of example can be made from plastic or metal, is expediently designed so as to be visually attractive, for instance is provided with a surface coating. In other words, the covering plate can therefore form or replace at least some of the housing wall, in particular an external housing wall, of the household appliance.

The advantageous embodiments and developments illustrated above and/or recited in the subclaims can—except for example in cases of clear dependencies or incompatible alternatives—be used individually or in any desired combination.

BRIEF DESCRIPTION OF THE DRAWINGS

The invention and its advantageous embodiments and developments as well as its advantages will be illustrated in more detail below with the aid of drawings, in which in a schematic diagram respectively.

DETAILED DESCRIPTION OF EXEMPLARY EMBODIMENTS OF THE PRESENT INVENTION

Figure 1:
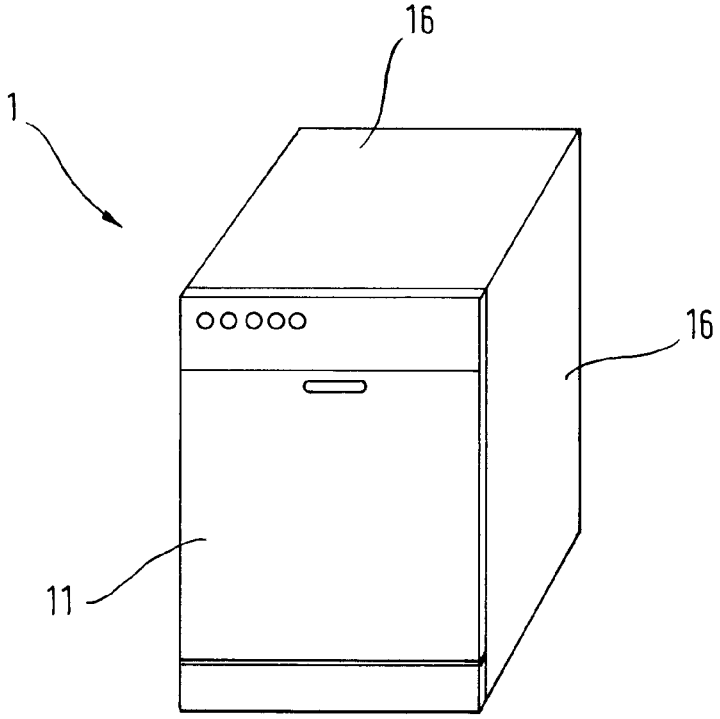
FIG. 1 shows by way of example of a household appliance a dishwasher in a perspective view which is constructed according to the inventive construction principle.

In FIGS. 1-5 mutually corresponding parts are provided with the same reference numerals. Only those components of a dishwasher which are necessary for an understanding of the invention are provided with reference numerals and explained. It is understood that the inventively constructed dishwasher can include further parts and assemblies.

FIG. 1 shows as an example of a household appliance a dishwasher 1 which comprises a washing tank 2. The inside thereof forms a dishwasher interior 3 which is used for receiving items to be washed, and which is an example of a space 5 of a household appliance surrounded by appliance walls 4. This dishwasher interior 3 comprises a front-side loading opening 12 which can be closed by a door 11. Air-borne noise produced in the space 5 owing by way of example to treatment of articles such as crockery, should be prevented from penetrating to the outside via the appliance walls 4, i.e. in the case of a dishwasher 1 via the tank walls 6 surrounding the dishwasher interior 3, namely an upper tank wall 6*a*, two side tank walls 6*b*, a bottom tank wall 6*c* and a back wall (not visible in the diagrams). The appliance walls also include in particular the door 11, in particular the inner door thereof, which faces the dishwasher interior 3. For reasons of simplification and in place of these appliance walls delimiting the respective space, in particular the treatment tank, of a household appliance, reference will be made below to a washing tank and a tank wall 6 surrounding it. The top wall 6*a* is provided at least on the outside with air-borne noise insulation which comprises a covering plate, i.e. a covering element, 8 and an acoustic sealing frame 9. The top wall and also the two side walls 6*b* and the bottom wall 6*c* of the washing tank 2, preferably all washing tank walls 6, are particularly advantageously each overlaid with air-borne noise insulation of this kind. As may be seen in FIGS. 2 to 4, the covering plate 8 is arranged on the outer face 7 of the tank wall 6 so as to leave free a gap 10. The covering plate 8 is mounted in front of the tank wall 6 at a predefinable transverse distance 21 and is largely parallel thereto. It covers the tank wall 6 substantially completely to achieve optimum noise insulation. The gap 10, which is open at the side, is sealed with the aid of the sealing frame 9 arranged in the edge region 13 of the covering plate 8. The sealing frame 9 is made at least partially, preferably made completely, from an air-borne noise absorbing and/or reflective sealing material, wherein, by way of example, a noise-absorbing foam with preferably closed pores, and/or absorbent fleece, such as cotton and/or polyester fleece, may be considered here. In particular a material with primarily noise-absorbing properties, in particular an elastically and/or plastically deformable material, preferably foam, or absorbent fleece, can be used for the sealing material of the sealing frame.

The sealing frame can be in the form of a pre-fabricated part and be attached to the outer face 7 of a tank wall 6. Another possibility consists in the sealing frame 9 being provided on the outer face 7, for instance in the form of an initially viscous, subsequently hardening compound. The covering plate can then be pressed onto the sealing frame 9, by way of example while the latter is still in a viscous state, and be joined thereto, for example bonded. In the viscous state the sealing frame or the sealing material forming it can be substantially plastically deformable, so irregularities in the outer face 7, which are produced for instance due to constructions-related troughs or beads in a tank wall 6, can be compensated. In the case of a pre-fabricated sealing frame 9, this can likewise be made from a—plastically and/or an elastically—deformable sealing material, so compensation of irregularities in the outer face 7 of a tank wall 6 is possible.

Figure 2:
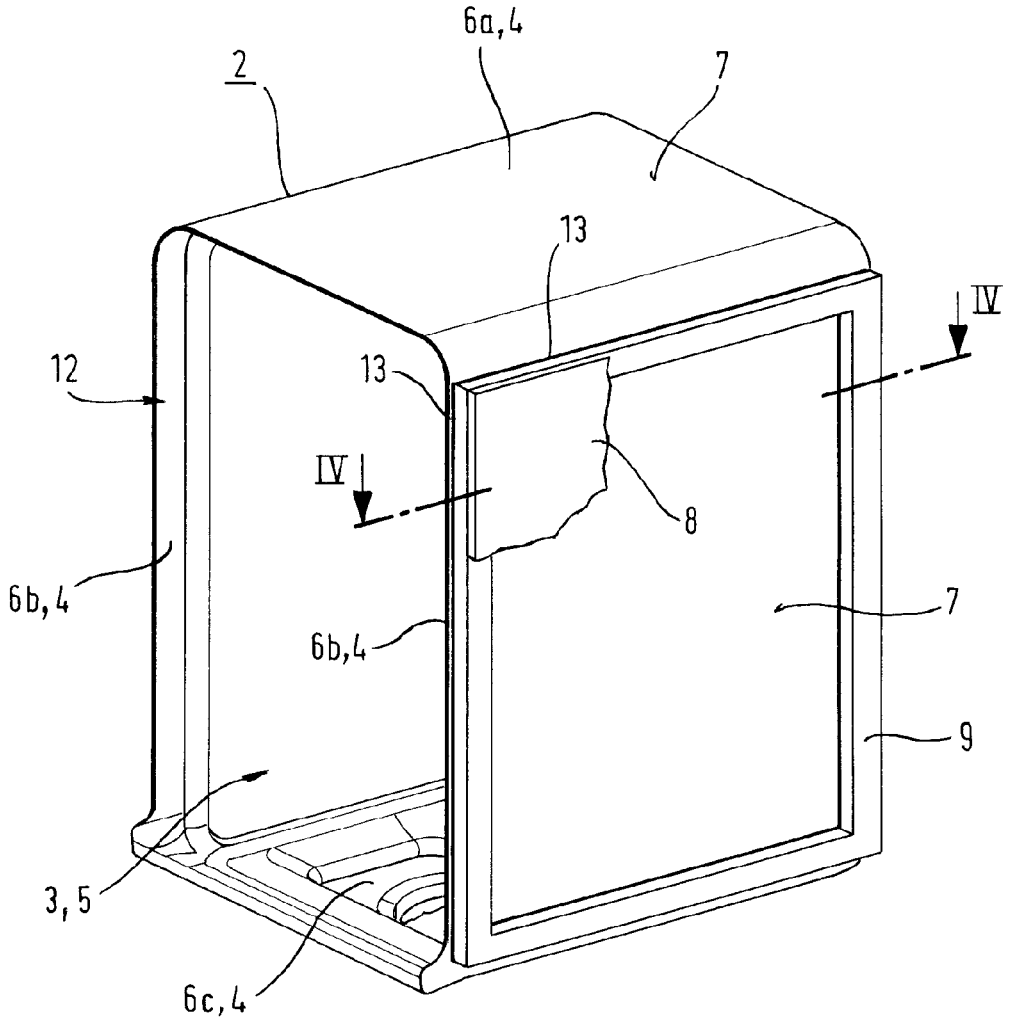
FIG. 2 shows in a perspective view a washing tank of the dishwasher in FIG. 1, to the outside of whose tank wall an acoustic sealing frame and a covering plate, i.e. a covering element, according to a first advantageous variant of the inventive construction principle, are attached.

In the exemplary embodiment of FIG. 2 the sealing frame 9 has a substantially rectangular geometric shape and rests with a substantially plane contact face on the respective tank wall 6. It covers the edge zone sections of the substantially rectangular tank wall 6 and projects outwardly with respect to the outer face 7 thereof by a predefinable transverse distance 21. The covering plate 8 is mounted on the outside of the sealing frame 9, and this covers the outer face 7' (see also FIG. 5) of the tank wall 6, which is enclosed all the way around by the sealing frame 9, so as to be soundproof.

The sealing material at least partially forming the sealing frame 9 is primarily a material which absorbs the air-borne noise prevailing in the gap 10, by way of example a foam, as already mentioned above, or another material comprising irregularities in the form of pores. The covering plate 8 is used primarily to prevent air-borne noise transmitted from the washing tank 2 and/or the tank wall into the gap 10 from spreading further and passing into the surroundings. This can be ensured firstly by a sound-damping, i.e. sound-reflecting sheet material. Plastic- and/or metal sheets may be considered here by way of example. In addition, fibers such as cotton, kenaf and/or plastic fibers, by way of example polyester fibers, and covering plates formed from cardboard may also be used. Owing to their fibrous structure comprising micro-cavities such sheets optionally also have sound-damping, i.e. sound-absorbing properties.

The production of air-borne noise in the gap 10 is reduced in an optional preferred embodiment in that an anti-drumming layer 14 is attached, by way of example glued, to the outer face 7 of a tank wall 6, bitumen pads primarily being used here, which, owing to their weight, bring about good structure-borne noise and vibration damping of the tank walls 6. The anti-drumming layer 14 covers the region of the outer face 7 of the tank wall 6 surrounded by the sealing frame 9. The acoustic sealing frame 9 can be directly fixed to the outer face 7, for instance glued, if the anti-drumming layer is not larger than the surface area of the outer face 7 surrounded by the sealing frame 9. However, it is also conceivable for the anti-drumming layer 14 to extend further outwards, so the sealing frame rests on the anti-drumming layer 14, and is therefore indirectly connected to the tank wall 6 (see left-hand half of FIG. 4).

Said parts, i.e. covering plate 8, sealing frame 9, optionally anti-drumming layer 14 and tank wall 6, can be easily fixed to each other by a glued joint. Other securing means, such as mechanical fixings, may of course also be expedient as well as or independently of a glued joint. A gap space 15 which receives said parts and is present between a tank wall 6 and a housing wall 16 flanking it, in particular an external housing wall, can be dimensioned such that there is a gap 17 between the covering plate 8 and the housing wall 16. The housing wall 16' can, however, also, as is shown in the left-hand half of FIG. 4, rest on the covering plate 8 without leaving a gap. In this case a glued joint between covering plate 8 and sealing frame 9 is not imperative since said parts are held positively or fixedly in the gap space 15 by the tank wall 6 and the housing wall 16 arranged at a predefined transverse distance therefrom.

Figure 3:
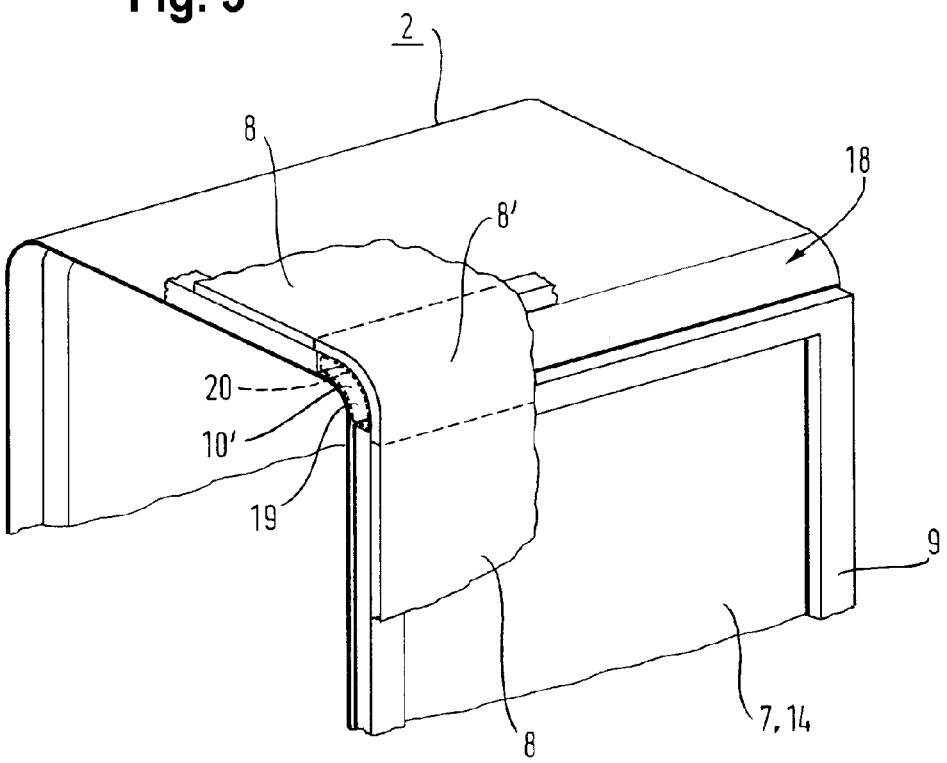
FIG. 3 shows in a perspective view part of a washing tank of the dishwasher in FIG. 1, in which an acoustic sealing frame and a covering plate according to a second advantageous variant of the inventive construction principle are present at a corner region of the washing tank.
Figure 4:
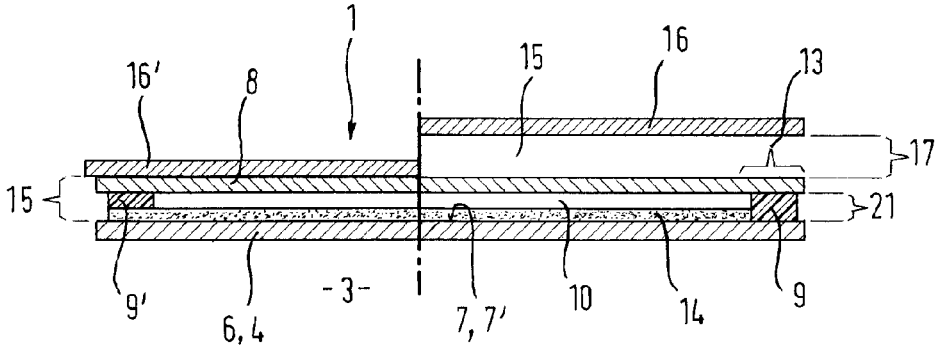
FIG. 4 shows a section along line IV-IV in FIG. 2 perpendicular to a washing tank side wall, wherein an external housing wall of the dishwasher, not shown in FIG. 2, has been added, and FIG. 5 schematically shows in a perspective view the top wall of the washing tank of the dishwasher in FIG. 1, on the outside of which a sealing frame with associated cover is provided, forming an advantageous noise insulation arrangement.

As may be seen from FIG. 3, a corner region 18, at which two adjacent tank walls 6 abut, can also be covered by a covering plate 8', wherein a section 19 of the sealing frame 9, which is indicated in FIG. 3 by a broken line 20, extends in a gap 10' present between the covering plate 8' and the corner region 18. The section 19 can be constructed as a separate part or be integrally constructed with one or more frame(s) 9.

According to an advantageous variant part or all of the housing wall, in particular an external housing wall, such as 16, can be omitted. In other words, the covering plate, such as 8, then partially or completely forms an external housing wall of the dishwasher, i.e. the covering plate at least partially replaces the external housing wall.

In particular the sealing frame can be formed by a preferably noise-absorbing structured or panel element, which in its physical structure or in its panel interior comprises an opening surrounded by edge zone portions of the structured or panel element. A preferably noise-absorbing foam or fleece element, in particular a substantially flat foam or fleece mat, preferably cotton fleece and/or polyester fleece mat, by way of example can be provided as the sealing frame which—preferably for instance in a central region of its planar extent—is punched through and therefore has a through-opening enclosed by remaining edge zone sections of the foam or fleece element. The noise-absorbing structured or panel element can in particular be formed by a component that is already present anyway in the construction of the respective household appliance, in particular the dishwasher. The opening or cutout is provided therein at a position at which there is little space for adhering to predefined appliance measurements on the outside of the washing tank. Such a position can by way of example be where a wall of the washing tank has an outwardly pointing curvature or protrusion. For example the top wall of the washing tank is outwardly curved for instance in a central region to give its inside wall surface in the dishwasher interior a convex shape, so washing liquor sprayed onto it during the respective liquid-conveying part-cycle can drain from it better to the vertical side walls and/or vertical back wall of the washing tank, and can then flow from there down to the bottom of the washing tank. Dripping of washing liquor from the inside wall surface of the top wall onto items to be washed, which are stored in a rack arranged in the dishwasher interior, is therefore reduced compared with the case of a plane top wall, or is largely avoided, and once the rinsing cycle of a started dishwashing program has finished, drying of the items is improved in the dishwasher interior during its concluding drying cycle. This shaping, i.e. outward curvature of the top wall of the washing tank, provides more space, for example for accommodating a top spray in the dishwasher interior at this central region of the top wall. There is a greater ceiling height in the dishwasher interior therefore. A cutlery drawer by way of example can therefore also be accommodated in the dishwasher interior above the upper rack that is conventionally present. The through-opening or recess in a sealing frame constructed in this way is then closed from outside by a covering element or cover. This can be mounted by way of example on the outer surfaces of the remaining sections of such a punched-through or cutout sealing frame with an edge zone so as to overlap. Noise-damping materials are sufficient for the cover in order to ensure a noise-insulating overall construction. The cover can therefore be produced by way of example from cardboard, fibers such as cotton, kenaf, polyester, and/or plastic. The layer thickness of the cover can advantageously be chosen to be thinner, in particular 1/6 to 1/2 times thinner than the layer thickness of the noise-absorbing structured or panel element, and nevertheless an overall construction comprising preferably noise-absorbing frame element or sealing element and preferably noise-damping cover which closes the opening thereof can still be provided which is sufficiently sound-insulating, because soundwaves emitted or transferred from the respective appliance wall, such as the top wall of the washing tank, are reflected inwards by the cover to the appliance wall and/or the frame element and are partially or completely absorbed thereby. The cover supplements the acoustic sealing element which sits on the outside of the respective appliance wall and which protrudes outwardly with respect to the outer face of the appliance wall, which is enclosed all the way around by the sealing element, by a predefined transverse distance in such a way that a cavity or gap (see 10 in FIG. 4) is enclosed between the appliance wall, sealing element and cover. Perfect noise encapsulation of the respective appliance wall is provided as a result. The material of the acoustic sealing frame and cover can optionally also be constructed so as to be thermally insulating, so, in addition, the energy efficiency of the dishwasher can be improved during its operation compared with the case where only a bitumen mat is provided on the respective tank wall.

Figure 5:
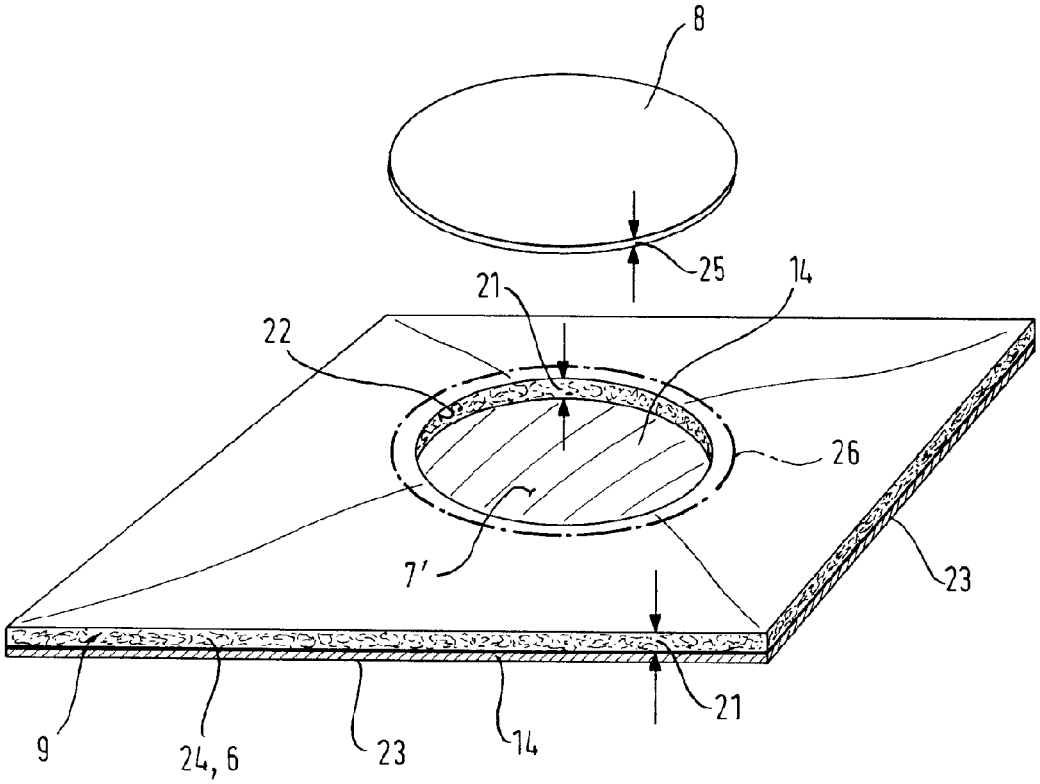

FIG. 5 schematically shows in a perspective diagram the top wall 23 of the washing tank of the dishwasher 1 in FIG. 1. It is outwardly, i.e. convexly, curved in a central region. A bitumen mat sits on the outside of the top wall 23 as an anti-drumming layer 14. This can be secured for example by means of an adhesive to the outer face of the top wall 23. According to an alternative variant it can optionally be loosely mounted on the top wall 23 and be fixed in position there in some other way. On the outside of the top wall 23 overlaid with the bitumen mat 23 there is laid a predominantly noise-absorbing structured element or panel element 24, in particular a fleece, preferably cotton or polyester fleece, or a foam layer. It can be only loosely laid on the anti-drumming layer 14 but is preferably glued to the anti-drumming layer 14, or fixed in position on it in some other way. In a central region where the top wall has its outward protrusion or curvature it is provided with a through-opening 22. This is closed from outside by a cover 8 which is externally mounted on an edge zone of the noise-absorbing structured or panel element 24 which surrounds the through-opening 22 all the way around. In FIG. 5 this edge zone, along whose course the cover 8 sits on the outside of the structured or panel element 24 so as to make contact with it, is shown in dot-dash lines and provided with reference numeral 26. The edge zone 26 therefore forms the overlapping region between the cover 8 and the material of the structured or panel element 24. In the exemplary embodiment of FIG. 5 the through-opening 22 and, corresponding thereto, the cover 8, are substantially circular in design. Other geometric forms are of course possible for the through-opening and the cover. A predominantly noise-reflecting material, such as cellulose, in particular cardboard, and/or embossed fleece, in particular cotton, kenaf, and/or polyester fleece, plastic, and/or metal is selected for the cover 8. The cover 8 has a layer thickness 25 which is lower, in particular between 10% and 50%, lower than the layer thickness 21 of the predominantly noise-absorbing structured or panel element 24. As a result, predefined height dimensions for the overall construction of the dishwasher can be adhered to even where the top wall of the washing tank thereof is outwardly curved, and perfect noise insulation or noise shielding of the washing tank is nevertheless ensured in the region of the top wall. The layer thickness 25 of the cover 8 is preferably chosen between 1 and 5 mm. The layer thickness 21 of the structured or panel element 24 is chosen in particular between 5 and 30 mm.

The layer thickness 25 of the cover 8 can expediently be chosen to be thin such that the level, which the cover 8 assumes on the structured or panel element 24 in its final assembled state, lies in particular at approximately the same height at which the outer surfaces of the edge zone sections 13 of the structured or panel element 24, which surround through-opening 22 all the way around, are arranged. The overall construction of the structured or panel element 24 and the cover or the cover layer for covering the through-opening 22 therefore has an approximately flat or plane outer surface, which does not exceed a maximum permissible upper height limit, in the case of a construction and chosen layer thickness of this kind.

If a noise-absorbing material, such as foam is chosen for the structured or panel element 24 and a noise-reflecting material, such as embossed fleece, another fiber material, cardboard, and/or plastic and/or metal is chosen for the cover, a "spring/damper" composite system is provided such that perfect noise insulation is brought about despite the reduction in the space requirement and material.

The construction and statements described in relation to FIG. 5 with respect to the top wall may of course be transferred to noise insulation of other appliance walls of a household appliance as well. Thus by way of example the outside of the inner wall (inner door) of the door of a dishwasher can also be provided with noise insulation constructed according to the invention. The housing of the circulation or wastewater pump of a dishwasher or another element of a dishwasher producing noise or sound can also advantageously be fitted with noise insulation according to the inventive construction principle.

Generally speaking a sealing frame, such as 24, comprising an air-borne noise absorbing and/or reflecting sealing material is therefore mounted along edge zone sections, such as 13, of the respective appliance wall 4 in the case of a household appliance, in particular a dishwasher, with a space which is delimited by at least one appliance wall, such as the top wall 23. This sealing frame projects outwardly at a predefinable transverse distance, such as 21, with respect to the outer face (see 7' in FIG. 5) of the appliance wall, such as 23, which is enclosed by the sealing frame all the way around. A covering plate or cover 8 is mounted on the outside of the sealing frame and covers the outer face of the appliance wall, which is enclosed all the way around by the sealing frame, so as to be soundproof.

It is optionally also possible, albeit with greater production expenditure compared to a flat cover, for the cover to be inserted into the indentation of the through-hole of the acoustic sealing frame so as to be largely flush fitting.

What is claimed is:

1. A household appliance, comprising:

appliance walls delimiting an interior space;

an acoustic sealing frame having an inner surface facing an outer face of a corresponding one of the appliance walls and the acoustic sealing frame having a continuous inner periphery;

a covering plate positioned on an outer surface of the sealing frame that is opposite the inner surface such that the covering plate is spaced from the corresponding one of the appliance walls by the acoustic sealing frame;

a gap that is defined in an exterior direction facing away from the interior space by the covering plate and the gap is surrounded laterally by the continuous inner periphery of the acoustic sealing frame; and an anti-drumming layer positioned on the outer face of the corresponding one of the appliance walls within the gap and surrounding laterally by the continuous inner periphery of the acoustic sealing frame.

2. The household appliance of claim 1, wherein the interior space is a dishwasher interior of a dishwasher.

3. The household appliance of claim 1, wherein the acoustic sealing frame is made at least partially from a sealing material that is at least one of airborne noise absorbing and airborne noise reflecting.

4. The household appliance of claim 3, wherein the sealing material of the acoustic sealing frame includes a substantially noise-absorbing material.

5. The household appliance of claim 4, wherein the substantially noise-absorbing material is at least one of elastically deformable and plastically deformable.

6. The household appliance of claim 5, wherein the substantially noise-absorbing material is foam, absorbent fleece or felt.

7. The household appliance of claim 1, wherein the anti-drumming layer is a bitumen mat.

8. The household appliance of claim 1, wherein the covering plate and the acoustic sealing frame extend over a corner region of the interior space.

9. The household appliance of claim 1, wherein the acoustic sealing frame is fixed to the corresponding one of the appliance walls by at least one of mechanical securement and gluing.

10. The household appliance of claim 1, wherein the covering plate is fixed to the acoustic sealing frame by at least one of mechanical securement and gluing.

11. The household appliance of claim 1, further comprising an additional external housing wall which flanks the appliance walls, wherein the acoustic sealing frame and the covering plate are positively held in a gap space between the at least one appliance wall and the additional external housing wall.

12. The household appliance of claim 11, wherein the covering plate forms or replaces at least part of the external housing wall.

13. The household appliance of claim 1, wherein the covering plate is produced from a substantially air-borne noise damping material.

14. The household appliance of claim 13, wherein the substantially air-borne noise damping material includes fibers selected from the group consisting of cotton, kenaf, and polyester fibers, or includes at least one of embossed fleece or felt, cardboard, and plastic.

15. The household appliance of claim 1, wherein the acoustic sealing frame has a geometric shape which is closed all the way around, and is mounted on an edge zone of the at least one appliance wall.

16. The household appliance of claim 15, wherein the sealing frame has a substantially rectangular configuration.

17. The household appliance of claim 1, constructed as a dishwasher, wherein the interior space is a dishwasher interior and the appliance walls are washing tank walls, and wherein the dishwasher interior is surrounded by the washing tank walls and a door, with at least one of the washing tank walls and an inner wall of the door being externally provided with an acoustic sealing frame and a covering plate.

18. The household appliance of claim 1, wherein the acoustic sealing frame is formed by a structured or panel element which has a through-opening, said covering plate closing the through-opening.

19. The household appliance of claim 18, wherein the structured or panel element is an acoustic insulation mat or an acoustic and thermal insulation mat.

20. The household appliance of claim 18, wherein the structured or panel element is produced from a substantially air-borne noise absorbing material.

21. The household appliance of claim 18, wherein the structured or panel element is produced from an absorbent fleece.

22. The household appliance of claim 1, wherein the acoustic sealing frame has a through-opening and is mounted on the corresponding one of the appliance walls in such a way that the through-opening comes to rest over a three-dimensionally contoured uneven or outwardly projecting partial area of the corresponding one of the appliance walls.

23. The household appliance of claim 1, wherein the acoustic sealing frame rests largely completely on a substantially planar partial area of the corresponding one of the appliance walls.

24. The household appliance of claim 23, wherein the substantially planar partial area is an edge zone area of the corresponding one of the appliance walls.

25. The household appliance of claim 1, wherein the covering plate is constructed so as to be substantially planar.

26. The household appliance of claim 1, wherein the covering plate has a layer thickness which is less than a layer thickness of the acoustic sealing frame.

27. The household appliance of claim 1, wherein the covering plate is shaped and dimensioned to overlap an edge zone on an outside of the acoustic sealing frame to cover a through-opening of the acoustic sealing frame.

28. The household appliance of claim 1, wherein the acoustic sealing frame comprises a plurality of elongate frame sections.

29. The household appliance of claim 28, wherein the plurality of elongate frame sections define the continuous inner periphery.

30. The household appliance of claim 1, wherein the gap comprises a void.

31. A household appliance, comprising:

an appliance wall delimiting an interior space;

an acoustic sealing frame having an first surface proximal to the appliance wall and a second surface distal from the appliance wall;

a covering plate attached to the second surface of the acoustic sealing frame such that an outer face of the appliance wall is covered by the covering plate;

a gap to provide noise insulation, said gap being defined in an exterior direction that faces way from the interior space by the covering plate, and said gap being surrounded in a lateral direction by a continuous inner periphery of the acoustic sealing frame; and an anti-drumming layer positioned on the outer face of the appliance wall within the gap and surrounding laterally by the continuous inner periphery of the acoustic sealing frame.

32. The household appliance of claim 31, wherein the acoustic sealing frame is made at least partially from a sealing material that is at least one of airborne noise absorbing and airborne noise reflecting.

33. The household appliance of claim 32, wherein the sealing material of the acoustic sealing frame includes a substantially noise-absorbing material.

34. The household appliance of claim 33, wherein the substantially noise-absorbing material is at least one of elastically deformable and plastically deformable.

35. The household appliance of claim 34, wherein the substantially noise-absorbing material is foam, absorbent fleece or felt.

36. The household appliance of claim 31, wherein the anti-drumming layer is a bitumen mat.

37. The household appliance of claim 31, wherein the covering plate and the acoustic sealing frame extend over a corner region of the interior space.

38. The household appliance of claim 31, wherein the acoustic sealing frame is fixed to the appliance wall by at least one of mechanical securement and gluing.

39. The household appliance of claim 31, wherein the covering plate is fixed to the acoustic sealing frame by at least one of mechanical securement and gluing.

40. The household appliance of claim 31, further comprising an additional external housing wall which flanks the appliance wall, wherein the acoustic sealing frame and the covering plate are positively held in a gap space between the appliance wall and the additional external housing wall.

41. The household appliance of claim 40, wherein the covering plate forms or replaces at least part of the external housing wall.

42. The household appliance of claim 31, wherein the covering plate is produced from a substantially air-borne noise damping material.

43. The household appliance of claim 42, wherein the substantially air-borne noise damping material includes fibers selected from the group consisting of cotton, kenaf, and polyester fibers, or includes at least one of embossed fleece or felt, cardboard, and plastic.

44. The household appliance of claim 31, wherein the acoustic sealing frame has a geometric shape which is closed all the way around, and is mounted on an edge zone of the appliance wall.

45. The household appliance of claim 44, wherein the acoustic sealing frame has a substantially rectangular configuration.

46. The household appliance of claim 31, constructed as a dishwasher, wherein the interior space is a dishwasher interior and the appliance wall comprises washing tank walls, and wherein the dishwasher interior is surrounded by the washing tank walls and a door, with at least one of the washing tank walls and an inner wall of the door being externally provided with an acoustic sealing frame and a covering plate.

47. The household appliance of claim 31, wherein the acoustic sealing frame is formed by a structured or panel element which has a through-opening, said covering plate closing the through-opening.

48. The household appliance of claim 47, wherein the structured or panel element is an acoustic insulation mat or an acoustic and thermal insulation mat.

49. The household appliance of claim 47, wherein the structured or panel element is produced from a substantially air-borne noise absorbing material.

50. The household appliance of claim 47, wherein the structured or panel element is produced from an absorbent fleece.

51. The household appliance of claim 31, wherein the acoustic sealing frame has a through-opening and is mounted on the appliance wall in such a way that the through-opening comes to rest over a three-dimensionally contoured uneven or outwardly projecting partial area of the appliance wall.

52. The household appliance of claim 31, wherein the acoustic sealing frame rests largely completely on a substantially planar partial area of the appliance wall.

53. The household appliance of claim 52, wherein the substantially planar partial area is an edge zone area of the appliance wall.

54. The household appliance of claim 31, wherein the covering plate is constructed so as to be substantially planar.

55. The household appliance of claim 31, wherein the covering plate has a layer thickness which is less than a layer thickness of the acoustic sealing frame.

56. The household appliance of claim 31, wherein the covering plate is shaped and dimensioned to overlap an edge zone on an outside of the acoustic sealing frame to cover a through-opening of the acoustic sealing frame.

57. The household appliance of claim 31, wherein the acoustic sealing frame comprises a plurality of elongate frame sections.

58. The household appliance of claim 57, wherein the plurality of elongate frame sections define the continuous inner periphery.

59. The household appliance of claim 31, wherein the gap comprises a void.

* * * * *